US008433461B2

(12) United States Patent
Daum et al.

(10) Patent No.: US 8,433,461 B2
(45) Date of Patent: Apr. 30, 2013

(54) METHOD OF PLANNING THE MOVEMENT OF TRAINS USING PRE-ALLOCATION OF RESOURCES

(75) Inventors: Wolfgang Daum, Erie, PA (US); John Hershey, Ballston Lake, NY (US); Randall Markley, Melbourne, FL (US); Mitchell Scott Wills, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 1515 days.

(21) Appl. No.: 11/591,521

(22) Filed: Nov. 2, 2006

(65) Prior Publication Data

US 2008/0109124 A1 May 8, 2008

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.
USPC ..... 701/19; 701/1

(58) Field of Classification Search ..... None
See application file for complete search history.

(56) References Cited

U.S. PATENT DOCUMENTS

| | | | | |
|---|---|---|---|---|
| 3,575,594 | A | | 4/1971 | Elcan |
| 3,734,433 | A | | 5/1973 | Metzner |
| 3,794,834 | A | | 2/1974 | Auer, Jr. et al. |
| 3,839,964 | A | | 10/1974 | Gayot |
| 3,895,584 | A | | 7/1975 | Paddison |
| 3,944,986 | A | | 3/1976 | Staples |
| 4,099,707 | A | | 7/1978 | Anderson |
| 4,122,523 | A | | 10/1978 | Morse et al. |
| 4,361,300 | A | | 11/1982 | Rush |
| 4,361,301 | A | | 11/1982 | Rush |
| 4,610,206 | A | | 9/1986 | Kubala et al. |
| 4,669,047 | A | | 5/1987 | Chucta |
| 4,791,871 | A | | 12/1988 | Mowll |
| 4,843,575 | A | | 6/1989 | Crane |
| 4,883,245 | A | | 11/1989 | Erickson, Jr. |
| 4,926,343 | A | | 5/1990 | Tsuruta et al. |
| 4,937,743 | A | | 6/1990 | Rassman et al. |
| 5,038,290 | A | | 8/1991 | Minami |
| 5,063,506 | A | | 11/1991 | Brockwell et al. |
| 5,177,684 | A | * | 1/1993 | Harker et al. ..... 701/117 |
| 5,222,192 | A | | 6/1993 | Shafer |

(Continued)

FOREIGN PATENT DOCUMENTS

| | | |
|---|---|---|
| CA | 2057039 | 12/1990 |
| CA | 2066739 | 2/1992 |

(Continued)

OTHER PUBLICATIONS

Crone, et al., "Distributed Intelligent Network Management for the SDI Ground Network," IEEE, 1991, pp. 722-726, MILCOM '91.

(Continued)

*Primary Examiner* — Khoi Tran
*Assistant Examiner* — Bhavesh V Amin
(74) *Attorney, Agent, or Firm* — John A. Kramer; GE Global Patent Operation

(57) ABSTRACT

A method of scheduling the movement of trains using the creation and the pre-allocation of virtual resources in order to develop an optimized schedule of actual train movement.

25 Claims, 4 Drawing Sheets

U.S. PATENT DOCUMENTS

| | | | | |
|---|---|---|---|---|
| 5,229,948 | A | 7/1993 | Wei et al. | |
| 5,237,497 | A | 8/1993 | Sitarski | |
| 5,265,006 | A | 11/1993 | Asthana et al. | |
| 5,289,563 | A | 2/1994 | Nomoto et al. | |
| 5,311,438 | A | 5/1994 | Sellers et al. | |
| 5,331,545 | A | 7/1994 | Yajima et al. | |
| 5,332,180 | A | 7/1994 | Peterson et al. | |
| 5,335,180 | A | 8/1994 | Takahashi et al. | |
| 5,365,516 | A | 11/1994 | Jandrell | |
| 5,390,880 | A | 2/1995 | Fukawa et al. | |
| 5,420,883 | A | 5/1995 | Swensen et al. | |
| 5,437,422 | A | 8/1995 | Newman | |
| 5,463,552 | A | 10/1995 | Wilson et al. | |
| 5,467,268 | A | 11/1995 | Sisley et al. | |
| 5,487,516 | A | 1/1996 | Murata et al. | |
| 5,541,848 | A | 7/1996 | McCormack et al. | |
| 5,623,413 | A * | 4/1997 | Matheson et al. | 701/117 |
| 5,740,046 | A * | 4/1998 | Elestedt | 701/117 |
| 5,745,735 | A | 4/1998 | Cohn et al. | |
| 5,794,172 | A * | 8/1998 | Matheson et al. | 701/117 |
| 5,823,481 | A | 10/1998 | Gottschlich | |
| 5,825,660 | A | 10/1998 | Cagan et al. | |
| 5,828,979 | A | 10/1998 | Polivka et al. | |
| 5,850,617 | A | 12/1998 | Libby | |
| 6,032,905 | A | 3/2000 | Haynie | |
| 6,115,700 | A | 9/2000 | Ferkinhoff et al. | |
| 6,125,311 | A | 9/2000 | Lo | |
| 6,144,901 | A | 11/2000 | Nickles et al. | |
| 6,154,735 | A | 11/2000 | Crone | |
| 6,250,590 | B1 | 6/2001 | Hofestadt et al. | |
| 6,351,697 | B1 | 2/2002 | Baker | |
| 6,377,877 | B1 | 4/2002 | Doner | |
| 6,393,362 | B1 | 5/2002 | Burns | |
| 6,405,186 | B1 | 6/2002 | Fabre et al. | |
| 6,459,965 | B1 | 10/2002 | Polivka et al. | |
| 6,587,764 | B2 | 7/2003 | Nickles et al. | |
| 6,637,703 | B2 | 10/2003 | Matheson et al. | |
| 6,654,682 | B2 * | 11/2003 | Kane et al. | 701/202 |
| 6,766,228 | B2 | 7/2004 | Chirescu | |
| 6,789,005 | B2 | 9/2004 | Hawthorne | |
| 6,799,097 | B2 | 9/2004 | Villarreal Antelo | |
| 6,799,100 | B2 | 9/2004 | Burns | |
| 6,853,889 | B2 | 2/2005 | Cole | |
| 6,856,865 | B2 | 2/2005 | Hawthorne | |
| 7,006,796 | B1 | 2/2006 | Hofmann et al. | |
| 2003/0105561 | A1 | 6/2003 | Nickles et al. | |
| 2003/0183729 | A1 | 10/2003 | Root et al. | |
| 2004/0010432 | A1 | 1/2004 | Matheson et al. | |
| 2004/0034556 | A1 | 2/2004 | Matheson et al. | |
| 2004/0093196 | A1 | 5/2004 | Hawthorne | |
| 2004/0093245 | A1 | 5/2004 | Matheson et al. | |
| 2004/0172175 | A1 * | 9/2004 | Julich et al. | 701/19 |
| 2004/0267415 | A1 | 12/2004 | Lacote et al. | |
| 2005/0107890 | A1 | 5/2005 | Minkowitz et al. | |
| 2005/0192720 | A1 | 9/2005 | Christie et al. | |
| 2006/0074544 | A1 | 4/2006 | Morariu et al. | |
| 2006/0212187 | A1 * | 9/2006 | Wills et al. | 701/19 |

FOREIGN PATENT DOCUMENTS

| | | |
|---|---|---|
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanabe, et al., "Moving Block System with Continuous Train Detection Utilizing Train Shunting Impedance of Track Circuit," QR of RTRI, vol. 30, No. 4, Nov. 1989, pp. 190-197.

* cited by examiner

METHOD OF PLANNING THE MOVEMENT OF TRAINS USING PRE-ALLOCATION OF RESOURCES

RELATED APPLICATIONS

The present application is related to the commonly owned U.S. patent application Ser. No. 11/415,273 entitled "Method of Planning Train Movement Using A Front End Cost Function", filed May 2, 2006, U.S. patent application Ser. No. 11/476,552 entitled "Method of Planning Train Movement Using A Three Step Optimization Engine", filed May 2, 2006, and U.S. patent application Ser. No. 11/518,250 entitled "Method of Planning Train Movement Using Multigeneration Positive Train Control", filed Sep. 11, 2006, all of which are hereby incorporated herein by reference.

BACKGROUND OF THE INVENTION

The present invention relates to the scheduling the movement of plural trains through a rail network, and more specifically, to the scheduling of the movement of trains over a railroad system utilizing the pre-allocation of resources.

Systems and methods for scheduling the movement of trains over a rail network have been described in U.S. Pat. Nos. 6,154,735, 5,794,172, and 5,623,413, the disclosure of which is hereby incorporated by reference.

As disclosed in the referenced patents and applications, the complete disclosure of which is hereby incorporated herein by reference, railroads consist of three primary components (1) a rail infrastructure, including track, switches, a communications system and a control system; (2) rolling stock, including locomotives and cars; and, (3) personnel (or crew) that operate and maintain the railway. Generally, each of these components are employed by the use of a high level schedule which assigns people, locomotives, and cars to the various sections of track and allows them to move over that track in a manner that avoids collisions and permits the railway system to deliver goods to various destinations.

As disclosed in the referenced patents and applications, a precision control system includes the use of an optimizing scheduler that will schedule all aspects of the rail system, taking into account the laws of physics, the policies of the railroad, the work rules of the personnel, the actual contractual terms of the contracts to the various customers and any boundary conditions or constraints which govern the possible solution or schedule such as passenger traffic, hours of operation of some of the facilities, track maintenance, work rules, etc. The combination of boundary conditions together with a figure of merit for each activity will result in a schedule which maximizes some figure of merit such as overall system cost.

As disclosed in the referenced patents and applications, and upon determining a schedule, a movement plan may be created using the very fine grain structure necessary to actually control the movement of the train. Such fine grain structure may include assignment of personnel by name, as well as the assignment of specific locomotives by number, and may include the determination of the precise time or distance over time for the movement of the trains across the rail network and all the details of train handling, power levels, curves, grades, track topography, wind and weather conditions. This movement plan may be used to guide the manual dispatching of trains and controlling of track forces, or may be provided to the locomotives so that it can be implemented by the engineer or automatically by switchable actuation on the locomotive.

The planning system is hierarchical in nature in which the problem is abstracted to a relatively high level for the initial optimization process, and then the resulting coarse solution is mapped to a less abstract lower level for further optimization. Statistical processing is used at all levels to minimize the total computational load, making the overall process computationally feasible to implement. An expert system is used as a manager over these processes, and the expert system is also the tool by which various boundary conditions and constraints for the solution set are established. The use of an expert system in this capacity permits the user to supply the rules to be placed in the solution process.

Currently, the movements of trains are typically controlled in a gross sense by a dispatcher, but the actual control of the train is left to the crew operating the train. Because compliance with the schedule is, in large part, the prerogative of the crew, it is difficult to maintain a very precise schedule. As a result it is estimated that the average utilization of these capital assets in the United States is less than 50%. If a better utilization of these capital assets can be attained, the overall cost effectiveness of the rail system will accordingly increase.

Another reason that the train schedules have not heretofore been very precise is that it has been difficult to account for the factors that affect the movement of trains when setting up a schedule. These difficulties include the complexities of including in the schedule the determination of the effects of physical limits of power and mass, speed limits, the limits due to the signaling system and the limits due to safe handling practices, which include those practices associated with applying power and braking in such a manner to avoid instability of the train structure and hence derailments. One factor that has been consistently overlooked in the scheduling of trains is the effect of the behavior of a specific crew on the performance of the movement of a train.

As more use is made of a railroad system, the return on infrastructure will be enhanced. Greater rail traffic will, however, lead to greater congestion and present dispatching systems will be strained and eventually incapable of handling the desired extra traffic load. The problem is further complicated by the impending necessity for an efficient transfer from a manual dispatch system to an automated dispatch system. There is therefore a need to devise new control strategies for more efficient dispatch procedures and concomitantly greater operating efficiencies of a railroad.

The present application is directed to planning the movement of trains through the use of virtual consists to achieve a more stable and efficient use of planning resources.

These and many other objects and advantages of the present disclosure will be readily apparent to one skilled in the art to which the disclosure pertains from a perusal of the claims, the appended drawings, and the following detailed description of the embodiments.

DETAILED DESCRIPTION

As railroad systems continue to evolve, efficiency demands will require that current dispatch protocols and methods be upgraded and optimized. It is expected that there will be a metamorphosis from a collection of territories governed by manual dispatch procedures to larger territories and ultimately to a single all encompassing territory, governed by an automated dispatch system.

At present, dispatchers control within a local territory. This practice recognizes the need for a dispatcher to possess local knowledge in performing dispatcher duties. As a result of this present structure, train dispatch is at best locally optimized. It is a byword in optimization theory that local optimization is almost invariably globally suboptimal. To move to fewer but wider dispatch territories would require significantly more data exchange and concomitantly much greater computational power in order to optimize a more nearly global scenario.

To some degree, the goal of all scheduling systems is to increase throughput of the system. This necessarily results in an increase in the congested areas of the system. With respect to scheduling rail traffic, the trend of combining dispatch areas coupled with increasing throughput has resulted in a new problem of how to manage the resulting congested areas. In one embodiment of the present disclosure it is possible to achieve optimization by introducing artificial constraints in congested areas, and subsequently, selectively removing the artificial constraints. This pre-allocation of artificial resources allows for a more stable overall system plan by equalizing total density across the network. In one embodiment, the artificial resources may include virtual consists allocated based on historical data from actual consists. In the context of this application, a consist is a power unit and a corresponding set of cars motivated by the power unit.

Figure 1:
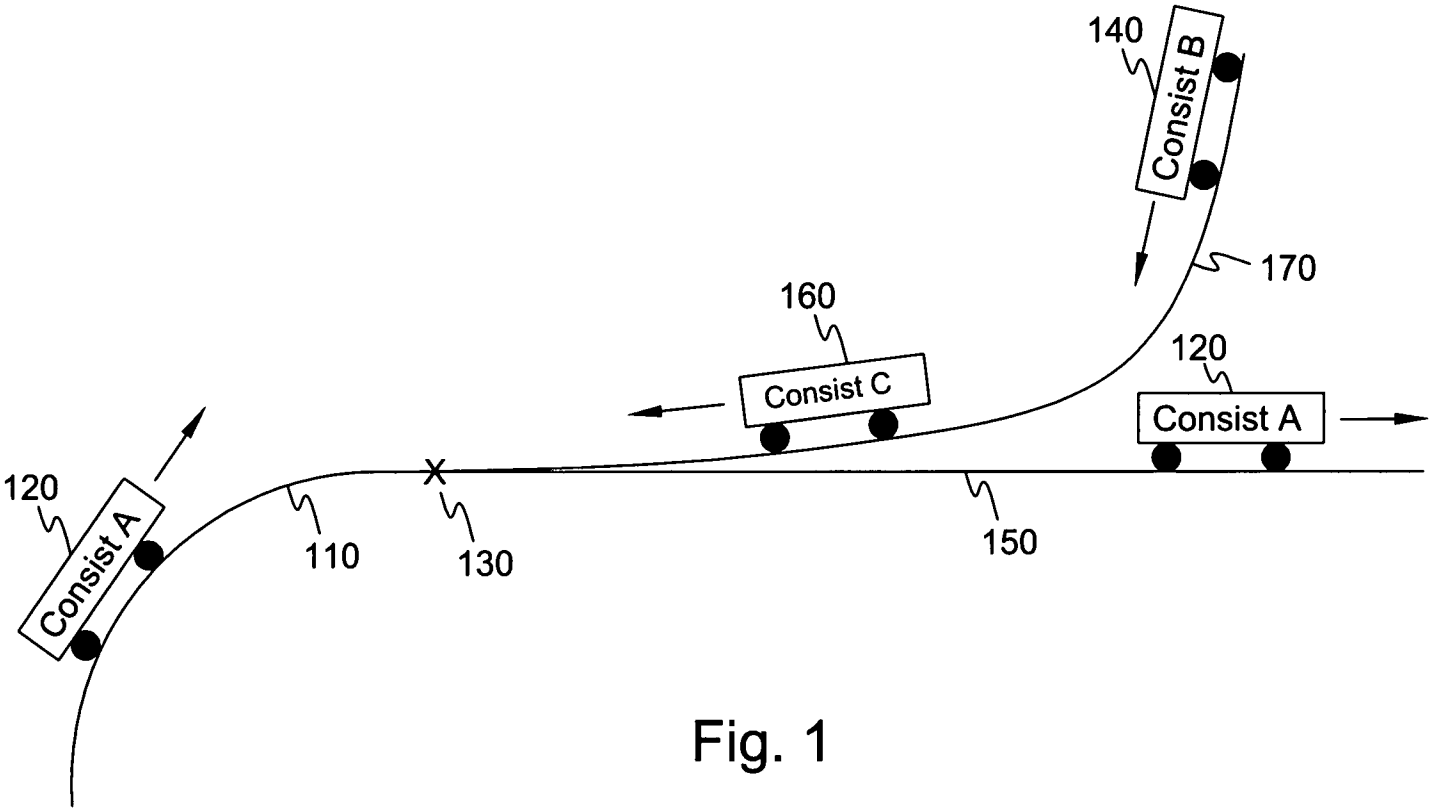
FIG. 1 is a simplified pictorial representation of the use of pre-allocation of resources in one embodiment of the present disclosure.

FIG. 1 illustrates the use of a virtual consist to developed an optimized schedule in one embodiment. Consist A 120 and consist B 140 are both traveling toward a merge point or switch 130. Before reaching merge point 130, consist A is traveling on track 10, and consist B is traveling on track 170. Virtual consist C 160 is introduced into the scheduling problem by placing virtual consist C ahead of consist B on track 170. The selective placement of the virtual consist C requires that the scheduler plan for the movement of the virtual consist by creating sufficient space between virtual consist C and actual consist B. As a result, actual consist A passes the merge point 130 and is safely on track 150 before consist B arrives at the merge point 130 to be switched onto track 110.

In another embodiment, because the planner does not distinguish between actual and virtual consists, the generated movement plan includes the planned movement of both actual and virtual consists. This plan affords the dispatcher additional flexibility that did not exist in prior art movement plans. For example, the dispatcher may substitute an actual consist for the virtual consist and control the movement of the substituted actual consist in accordance with the movement plan generated for the virtual consist. The ability to substitute an actual consist for the virtual consist avoids the necessity of having to run a new planning cycle if the dispatch wants to add a consist to the movement plan.

In another embodiment of the present invention, a virtual consist can be used to influence the scheduled order of the trains at a meet point. With continued reference to FIG. 1, virtual consist C can be asserted in front of actual consist B to ensure that consist A is scheduled to arrive at merge point 130 prior to consist B. Thus by selectively placing virtual consists ahead of or behind an actual consist, the time or arrival or departure of the actual consist can be affected which can be used to influence the order of the actual trains at a meet point.

In another aspect of the present disclosure, the placement and the characteristic of the virtual consist can be determined. In one embodiment, a review of historical performance data for the actual movement of the trains can be used to identify locations in which to use a virtual consist. For example a review of the average time or average speed it takes a consist to transit a portion can be used to identify choke points in the track topology that may benefit from the use of a virtual consist. In another embodiment, the location in which to use a virtual consist can be based on the planned movement of the trains. For example, if the planned movement of the trains includes moving a predetermined number of trains through a track section within a predetermined period of time, the area can be determined as one that would benefit from the use of a virtual consist.

A virtual consist may be added deterministically or probabilistically. The same is true for the removal of a virtual consist. Thus the method of adding or removing a virtual consists allows deterministic and probabilistic modes. These modes may operate exclusively or in combination.

The motivation for using virtual consists is to inject greater stability into the operation of the rail system and thereby reap a greater efficiency. The optimal management of virtual consists depends upon several factors including, but not limited to, the weather, the track topography, track speed restrictions, the real consists in route including their positions, their make-up, their crew capabilities, and other special and significant attributes. Because an optimal solution to the planned movement of virtual consists is an open problem, the task is approached by combining solutions of pieces of the larger rail system planning problem with stored historical results of train movements.

In one embodiment, a deterministic virtual consist can be made by inserting a virtual consist at a selected location after a real consist has passed the insertion point by a predetermined distance and before another consist reaches a predetermined distance from the insertion point thus maintaining a mandated separation between the real and virtual consists. The characteristics of the virtual consist can be based on the historical performance of an actual consist in predicting the planned movement of the virtual consist. For example, if the movement of a long heavy train through a predetermined track section results in an average transit time of Q, a virtual consist having the same physical characteristics can be generated when it is desirable to insert a delay of approximately the same as the average transit time Q. Thus, the length and speed and other characteristics of the virtual consist are chosen according to algorithmic and historical data that maximizes the efficiency of the rail system by promoting greater stability.

A deterministic virtual consist removal can be implemented when the spacing between actual consists must be shortened in order to decrease expected arrival time or arrival time variance or for any other metric that is selected for estimating rail system efficiency.

In another embodiment, a probabilistic virtual consist insertion can be implemented as a function of a probability criterion driven by a random, or pseudorandom, number generator. The location of the insertion and the characteristics of the virtual consist can be determined as described above with respect to the deterministic insertion. The virtual consist may be removed at any time that the spacing between actual consists must be shortened in order to decrease expected arrival time or arrival time variance or for any other metric that is selected for estimating rail system efficiency.

Figure 2:
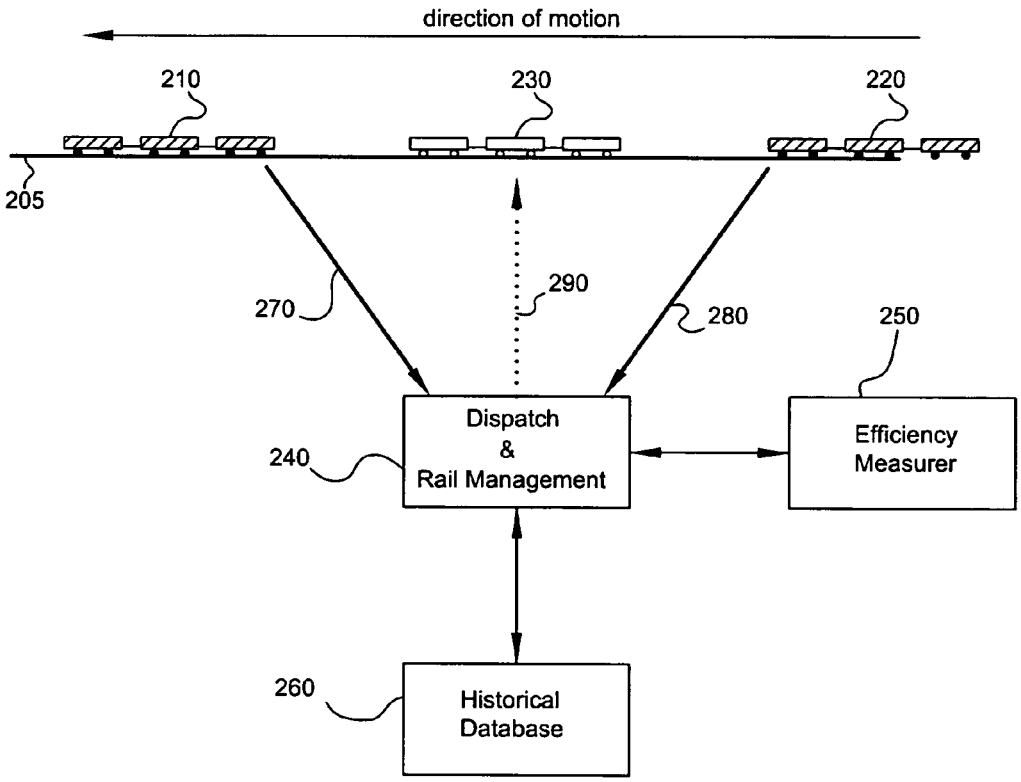
FIG. 2 is a simplified pictorial representation of the use of pre-allocation of resources in another embodiment of the present disclosure.

FIG. 2 is a high level example of a virtual consist insertion. Two actual real consists 210 and 220 are moving right-to-left on a rail 205. The rear position of consist 210 is reported via data transfer link 270 to a dispatch and rail management facility 240 as is the front position of consist 220 also reported via data transfer link 280. A computational engine in the dispatch and rail management facility 240 may determine by calculation involving several variables that the stability of the rail system and concomitantly the efficiency of the system can be improved by inserting a virtual consist 230 between actual consists 210 and 220, as described in more detail below. For example, insertion of the virtual consist 230 can be made with the virtual consist moving right-to-left with a speed that will cause consist 220 to adjust and modulate its speed. The dotted line 290 designates the insertion and insertion point of the virtual consist The dispatch and rail management module 240 may be in communication with an efficiency measurer module 250 and an historical database module 260 for evaluating whether an insertion of a virtual consist is desirable and determining the location and characteristics of the virtual consist. For example, efficiency measurer module 250 may calculate the efficiency of the planned rail system operation with and without a virtual consist. If a virtual consist is expected to increase efficiency by a predetermined amount, then the dispatch and rail management facility 240 inserts a virtual consist. The efficiency of the rail system may be calculated with and without a virtual consist using a simulation tool, and the resulting efficiencies are compared. The results may be stored in the historical database 260.

The efficiency of the movement plan may be determined by evaluating the throughput, cost or other metric which quantifies the performance of the movement plan and can be used for comparison between plans. For example, the stability of a movement plan is an important consideration and can be quantified by evaluating the expected variance in a planned movement. For example, with reference to FIG. 3A-D, the efficiency of a movement plan can be evaluated by comparing the stability of the plan with and without the addition of a virtual consist. In one embodiment, a behavioral model can be created using an associated transfer function that will predict the movements and positions of a train under the railroad conditions experienced at the time of prediction. The transfer function is crafted in order to reduce the variance of the effect of the different crews, thereby allowing better planning for anticipated delays and signature behaviors. The model data can be shared across territories and more efficient global planning will result.

Figure 3A:
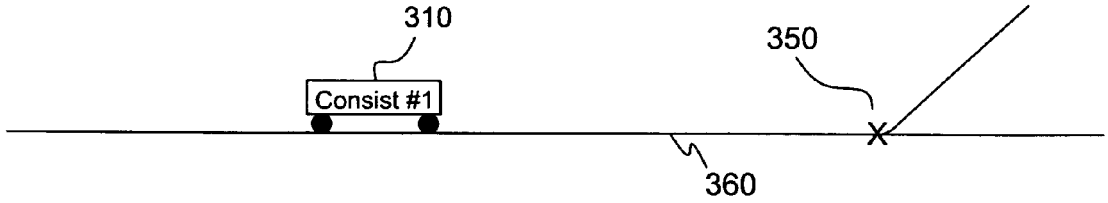
FIG. 3A-D are a simplified pictorial representation of the evaluation of the impact of a use of the pre-allocation of resources on a movement plan in one embodiment of the present disclosure.

In FIG. 3A, Consist #1 310 is on track 360 and proceeding to a point 350 designated by an 'X'. The behavior of the consist is modeled by its respective behavior models, which take into account the rail conditions at the time of the prediction. The rail conditions may be characterized by factors which may influence the movement of the trains including, other traffic, weather, time of day, seasonal variances, physical characteristics of the consists, repair, maintenance work, etc. Another factor which may be considered is the efficiency of the dispatcher based on the historical performance of the dispatcher in like conditions.

Figure 3B:
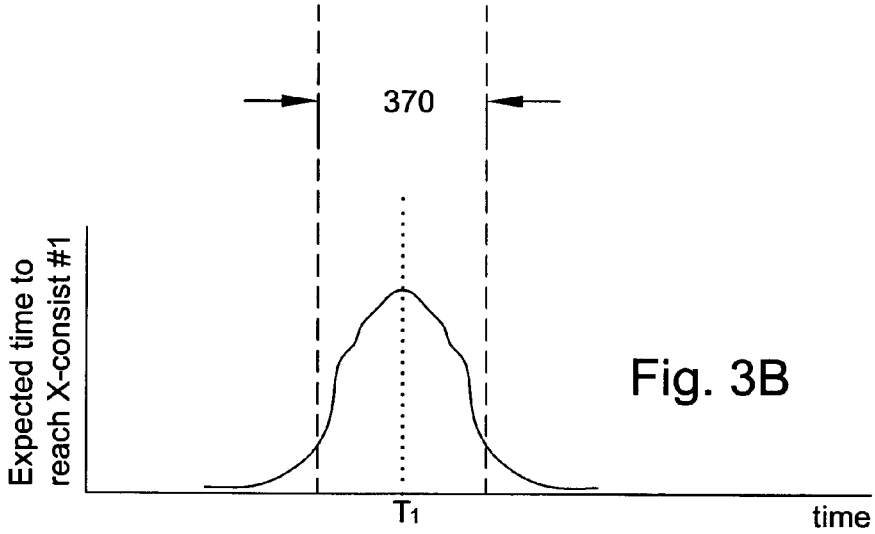

Using the behavior model, a graph of expected performance for consist #1 310 can be generated. FIG. 3B is a graph of the expected time of arrival of consist #1 310 at the merge point 350. The expected arrival time for consist #1 is $T_1$, and the variance of the expected arrival time is 370.

Figure 3C:
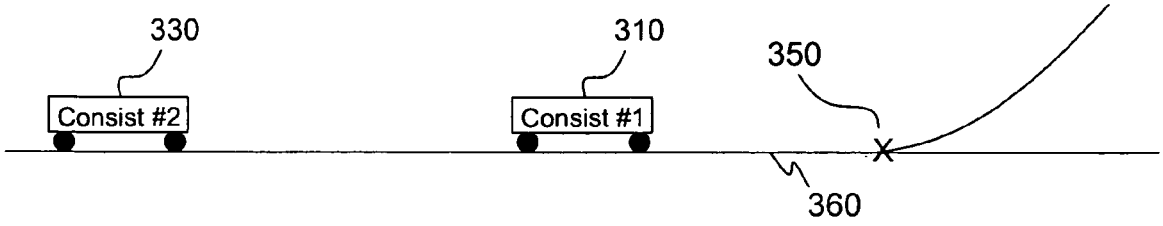
Figure 3D:
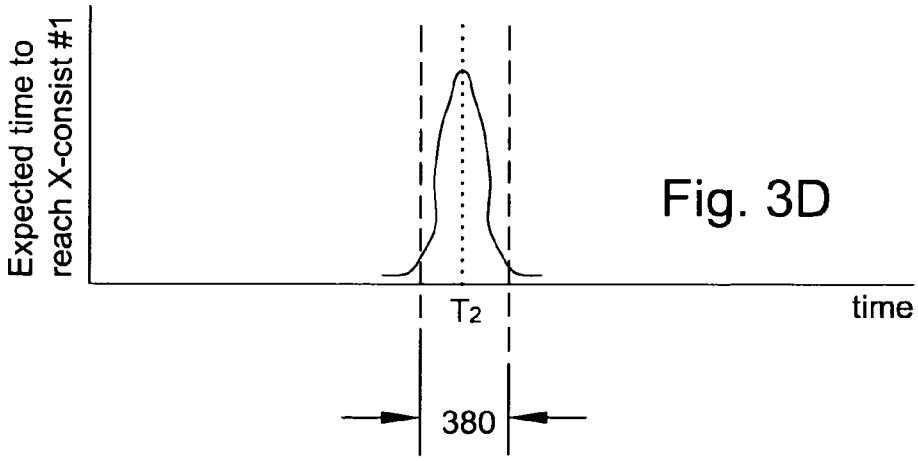

In FIG. 3C, virtual consist #2 330 is added to the scheduling problem and is placed behind consist #1 310 traveling towards point X 350. Using the behavior model, a graph of expected performance for consist #1 310 when virtual consist #2 330 is added can be generated. FIG. 3D is a graph of the expected time of arrival of consist #1 310 at the point X 350 when virtual consist #2 is planned behind consist #1 310. The expected arrival time for consist #1 is $T_2$, and the variance of the expected arrival time is 380. The variance of expected arrival time 370 for consist #1 310 without the virtual consist #2 330 is larger than the variance of expected time of arrival 380 for consist #1 310 when the virtual consist #2 330 is added, and thus the addition of the virtual consist decreases the variance and therefore increases the stability of the movement plan for the consist #1. For this example, the movement plan with the addition of the virtual consist produces a more stable movement plan and thus the use of the virtual consist is desirable.

The behavior of a specific consist can be modeled as a function of the past performance of the consist. For example, a data base 260 may be maintained that collects train performance information mapped to the characteristics of the train consist. This performance data may also be mapped to the rail conditions that existed at the time of the train movement. This collected data can be analyzed to evaluate the past performance of a consist in the specified rail conditions and can be used to predict the future performance of a consist as a function of the predicted rail conditions.

The dispatch and rail management facility 240 may use the historical database 260 to search for similar cases in order to determine the location and characteristics of the inserted virtual consist. The data of any such cases may also be used to appropriately adjust the efficiency calculations.

The dispatch and rail management facility 240 may remove a virtual consist when appropriate calculations indicate the need for removing the timing or spacing between actual consists or when there is an exigency or other event that requires a closing of the distance between actual consists 210 and 220.

In another embodiment of the present disclosure, the characteristics of an actual consist may be altered to for a planning cycle to provide a benefit similar to that of the use of a virtual consist. For example, the characteristics of a actual consist, i.e., the size, weight, length, load, etc. may be altered in the planning system to create greater stability in the generation of movement plans. For example, altering the length of a train may increase separation between planned trains due to the increase length as well as the increased stopping distance of the lengthened train.

Although the embodiments above have been described wherein the pre-allocated resource is a virtual consist, other resources may be used to add flexibility and increase stability of the scheduling problem. For example, a virtual signal may be added that operates according the traffic, both real and virtual, to influence the planned movement of the trains.

The embodiments disclosed herein for planning the movement of the trains using pre-allocation of resources can be implemented using computer usable medium having a computer readable code executed by special purpose or general purpose computers. In addition, the embodiments disclosed may be implemented in a front-end preprocessor to the main optimizer, in the main optimizer, and/or as part of the repair scheduler.

While embodiments of the present disclosure have been described, it is understood that the embodiments described are illustrative only and the scope of the disclosure is to be defined solely by the appended claims when accorded a full range of equivalence, many variations and modifications naturally occurring to those of skill in the art from a perusal hereof.

What is claimed:

1. A method comprising:

generating a first movement plan for two or more actual rail vehicles, the first movement plan including a first set of schedules for the respective actual rail vehicles to travel according to within a network of tracks;

calculating a first efficiency measurement of the first movement plan using one or more processors, the first efficiency measurement based on simulated concurrent movements of the actual rail vehicles according to the first set of schedules of the first movement plan;

generating a different, second movement plan for the actual rail vehicles and at least one virtual rail vehicle, the second movement plan including a second set of schedules for the actual rail vehicles and the at least one virtual rail vehicle to concurrently travel according to within the network of tracks;

calculating a second efficiency measurement of the second movement plan using the one or more processors, the second efficiency measurement based on simulated concurrent movements of the actual rail vehicles and the at least one virtual rail vehicle according to the second set of schedules of the second movement plan; and selecting the first movement plan or the second movement plan for implementation in scheduling actual movements of the actual rail vehicles within the network of tracks based on a comparison of the first and second efficiency measurements.

2. The method of claim 1, wherein calculating the second efficiency measurement includes simulating concurrent movements of the actual rail vehicles and the at least one virtual rail vehicle according to the second set of schedules.

3. The method of claim 1, wherein calculating the first efficiency measurement and calculating the second efficiency measurement includes simulating movements of the actual rail vehicles according to the respective first or second set of schedules and identifying simulated variances between designated arrival times of the actual rail vehicles at associated locations and simulated arrival times of the actual rail vehicles at the associated locations.

4. The method of claim 1, wherein selecting the first movement plan or the second movement plan includes selecting the second movement plan when a difference between the first efficiency measurement and the second efficiency measurement exceeds a designated threshold.

5. The method of claim 1, wherein generating the second movement plan includes creating one or more schedules of the second set of schedules for the at least one virtual rail vehicle, the one or more schedules for the at least one virtual rail vehicle based on historical performance of at least one of the actual rail vehicles.

6. The method of claim 1, wherein generating the second movement plan includes inserting the at least one virtual rail vehicle into the network of tracks for concurrent movement of the at least one virtual rail vehicle with the actual rail vehicles.

7. The method of claim 6, wherein generating the second movement plan includes inserting the at least one virtual rail vehicle between first and second rail vehicles of the actual rail vehicles on a track segment that is scheduled to be concurrently traveled by the first and second rail vehicles in order to ensure at least a designated separation distance between the first and second rail vehicles.

8. The method of claim 6, wherein generating the second movement plan includes inserting the at least one virtual rail vehicle between a first rail vehicle of the actual rail vehicles and a merge point between first and second track segments in the network of tracks in order to ensure that the first rail vehicle actually arrives at the merge point no sooner than a time at which a second rail vehicle of the actual rail vehicles passes the merge point according to the first set of schedules of the first movement plan.

9. The method of claim 6, wherein generating the second movement plan includes inserting the at least one virtual rail vehicle between a first rail vehicle of the actual rail vehicles and a siding location in the network of tracks such that a temporal order in which the first rail vehicle and a second rail vehicle of the actual rail vehicles are scheduled to arrive at the siding location in the second set of schedules of the second movement plan is changed relative to the first set of schedules of the first movement plan.

10. The method of claim 1, further comprising implementing the second movement plan by communicating one or more schedules in the second set of schedules to the respective actual rail vehicles such that the actual rail vehicles travel in the network of tracks as though the at least one virtual rail vehicle is concurrently traveling in the network of tracks but without the at least one virtual rail vehicle actually traveling in the network of tracks.

11. The method of claim 1, wherein generating the second movement plan includes modifying the first set of schedules of the actual rail vehicles by virtually adding a virtual traffic control signal in the network of tracks and changing when one or more of the actual rail vehicles are allowed to travel on one or more segments of track in the network of tracks based on a virtual state of the virtual traffic control signal.

12. The method of claim 1, wherein the at least one virtual rail vehicle is an artificial constraint on generation of the second set of schedules and does not represent any of the actual rail vehicles to be moved over the network of tracks.

13. A system comprising:

a management module configured to generate a first movement plan for two or more actual rail vehicles and a different, second movement plan for the actual rail vehicles and at least one virtual rail vehicle, the first movement plan including a first set of schedules for the respective actual rail vehicles to travel according to within a network of tracks, the second movement plan including a second set of schedules for the actual rail vehicles and the at least one virtual rail vehicle to concurrently travel according to within the network of tracks; and an efficiency module configured to calculate a first efficiency measurement of the first movement plan and a second efficiency measurement of the second movement plan, the first efficiency measurement based on simulated concurrent movements of the actual rail vehicles according to the first set of schedules of the first movement plan, the second efficiency measurement based on simulated concurrent movements of the actual rail vehicles and the at least one virtual rail vehicle according to the second set of schedules of the second movement plan, wherein the management module is configured to select the first movement plan or the second movement plan for implementation in scheduling actual movements of the actual rail vehicles within the network of tracks based on a comparison of the first and second efficiency measurements.

14. The system of claim 13, wherein at least one of the management module or the efficiency module includes one or more processors.

15. The system of claim 13, wherein the efficiency module is configured to calculate the second efficiency measurement by simulating concurrent movements of the actual rail vehicles and the at least one virtual rail vehicle according to the second set of schedules.

16. The system of claim 13, wherein the efficiency module is configured to calculate the first efficiency measurement and the second efficiency measurement by simulating movements of the actual rail vehicles according to the respective first or second set of schedules and identifying simulated variances between designated arrival times of the actual rail vehicles at associated locations and simulated arrival times of the actual rail vehicles at the associated locations.

17. The system of claim 13, wherein the management module is configured to select the second movement plan when a difference between the first efficiency measurement and the second efficiency measurement exceeds a designated threshold.

18. The system of claim 13, wherein the management module is configured to create one or more schedules of the second set of schedules for the at least one virtual rail vehicle, the one or more schedules for the at least one virtual rail vehicle being created based on historical performance of at least one of the actual rail vehicles.

19. The system of claim 13, wherein the management module is configured to generate the second movement plan by inserting the at least one virtual rail vehicle into the network of tracks for concurrent movement of the at least one virtual rail vehicle with the actual rail vehicles.

20. The system of claim 19, wherein the management module is configured to generate the second movement plan by inserting the at least one virtual rail vehicle between first and second rail vehicles of the actual rail vehicles on a track segment that is scheduled to be concurrently traveled by the first and second rail vehicles in order to ensure at least a designated separation distance between the first and second rail vehicles.

21. The system of claim 19, wherein the management module is configured to generate the second movement plan by inserting the at least one virtual rail vehicle between a first rail vehicle of the actual rail vehicles and a merge point between first and second track segments in the network of tracks in order to ensure that the first rail vehicle actually arrives at the merge point no sooner than a time at which a second rail vehicle of the actual rail vehicles passes the merge point according to the first set of schedules of the first movement plan.

22. The system of claim 19, wherein the management module is configured to generate the second movement plan by inserting the at least one virtual rail vehicle between a first rail vehicle of the actual rail vehicles and a siding location in the network of tracks such that a temporal order in which the first rail vehicle and a second rail vehicle of the actual rail vehicles are scheduled to arrive at the siding location in the second set of schedules of the second movement plan is changed relative to the first set of schedules of the first movement plan.

23. The system of claim 13, wherein the management module is configured to implement the second movement plan by communicating one or more schedules in the second set of schedules to the respective actual rail vehicles such that the actual rail vehicles travel in the network of tracks as though the at least one virtual rail vehicle is concurrently traveling in the network of tracks but without the at least one virtual rail vehicle actually traveling in the network of tracks.

24. The system of claim 13, wherein the management module is configured to generate the second movement plan by modifying the first set of schedules of the actual rail vehicles in order to virtually add a virtual traffic control signal in the network of tracks and by changing when one or more of the actual rail vehicles are allowed to travel on one or more segments of track in the network of tracks based on a virtual state of the virtual traffic control signal.

25. The system of claim 13, wherein the at least one virtual rail vehicle is an artificial constraint on generation of the second set of schedules and does not represent any of the actual rail vehicles to be moved over the network of tracks.

* * * * *

UNITED STATES PATENT AND TRADEMARK OFFICE

CERTIFICATE OF CORRECTION

PATENT NO. : 8,433,461 B2
APPLICATION NO. : 11/591521
DATED : April 30, 2013
INVENTOR(S) : Daum et al.

It is certified that error appears in the above-identified patent and that said Letters Patent is hereby corrected as shown below:

In the Specification

In Column 2, Line 59, delete "FIG. 3A-D are a" and insert -- FIGS. 3A-D are --, therefor.

In Column 3, Line 36, delete "10," and insert -- 110, --, therefor.

Signed and Sealed this
Eighteenth Day of June, 2013

Teresa Stanek Rea
*Acting Director of the United States Patent and Trademark Office*